US010931046B2

(12) United States Patent
Komori et al.

(10) Patent No.: US 10,931,046 B2
(45) Date of Patent: Feb. 23, 2021

(54) CIRCUIT DEVICE

(71) Applicants: AutoNetworks Technologies, Ltd., Yokkaichi (JP); Sumitomo Wiring Systems, Ltd., Yokkaichi (JP); SUMITOMO ELECTRIC INDUSTRIES, LTD., Osaka (JP)

(72) Inventors: Hirokazu Komori, Yokkaichi (JP); Hisashi Sawada, Yokkaichi (JP); Naomichi Kawashima, Yokkaichi (JP); Hirokazu Eguchi, Itami (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/624,326

(22) PCT Filed: Jun. 27, 2018

(86) PCT No.: PCT/JP2018/024275
§ 371 (c)(1),
(2) Date: Dec. 19, 2019

(87) PCT Pub. No.: WO2019/009147
PCT Pub. Date: Jan. 10, 2019

(65) Prior Publication Data

US 2020/0127401 A1 Apr. 23, 2020

(30) Foreign Application Priority Data

Jul. 4, 2017 (JP) ..... JP2017-131185

(51) Int. Cl.
*H01R 12/71* (2011.01)
*H01R 13/52* (2006.01)

(52) U.S. Cl.
CPC ..... *H01R 12/716* (2013.01); *H01R 13/521* (2013.01); *H01R 13/5216* (2013.01)

(58) Field of Classification Search
CPC .. H01R 12/724; H01R 12/716; H01R 13/521; H01R 13/5216; H01R 13/405
See application file for complete search history.

(56) References Cited

U.S. PATENT DOCUMENTS 4,729,743 A * 3/1988 Farrar ..... H01R 13/6666 439/276
5,266,054 A * 11/1993 Duncan ..... H01R 13/5219 439/559

(Continued)

FOREIGN PATENT DOCUMENTS

JP 10-270602 10/1998
JP 2010-040992 2/2010

(Continued)

OTHER PUBLICATIONS

International Search Report dated Sep. 25, 2018.

*Primary Examiner* — Briggitte R. Hammond
(74) *Attorney, Agent, or Firm* — Gerald E. Hespos; Michael J. Porco; Matthew T. Hespos

(57) ABSTRACT

An ECU (1) includes a circuit board (10), a connector (20) fixed to the circuit board (10), and a resin portion (50) covering the circuit board (10) and the connector (20). The connector (20) includes a connector housing (21) having a terminal holding wall (22) that separates the internal space from the external space, and terminal fittings (41) extend through the terminal holding wall (22). The connector housing (21) includes a surrounding wall (27) disposed on the lateral surface of the terminal holding wall (22) to surround the terminal fittings (41). A potting material (28) is disposed inside the surrounding wall (27) and separates the terminal holding wall (22) from the resin portion (50). This (Continued)

can prevent a melted resin from entering a hood (24) through press fitting holes (23) at the time of forming the resin portion (50) by mold forming.

9 Claims, 9 Drawing Sheets

(56) References Cited

U.S. PATENT DOCUMENTS

| | | | | |
|---|---|---|---|---|
| 7,445,481 | B2 * | 11/2008 | Nagashima | H01R 13/5216 439/276 |
| 8,011,976 | B2 * | 9/2011 | Ooki | H01R 13/521 439/736 |
| 9,017,088 | B2 * | 4/2015 | Endo | H01R 13/52 439/276 |
| 2013/0149905 | A1 | 6/2013 | Endo et al. | |

FOREIGN PATENT DOCUMENTS

| | | |
|---|---|---|
| JP | 2010-055866 | 3/2010 |
| JP | 2013-120733 | 6/2013 |
| JP | 2014-165186 | 9/2014 |
| WO | 2014/132973 | 9/2014 |

* cited by examiner

CIRCUIT DEVICE

BACKGROUND

Field of the Invention

The technology disclosed in this specification relates to a circuit device.

Related Art

A structure in which an entire circuit board and a portion fixed to the circuit board through a connector are covered with a mold resin is known as a waterproof structure for a circuit device including a circuit board and a connector fixed to the circuit board (see Japanese Unexamined Patent Application Publication No. 2010-40992). The mold resin is formed by setting the circuit board in a forming mold, filling the mold with a melted resin, and curing the resin. The connector includes a connector housing having a partition wall and a cylindrical hood portion continuous from the partition wall and a terminal fitting having a tab portion disposed inside the hood portion so as to extend through the partition wall.

According to the above configuration, at the time of mold forming, the melted resin may enter the hood portion through the penetration portion of the tab portion.

SUMMARY

A circuit device disclosed in this specification is a circuit device including a circuit board, a connector fixed to the circuit board, and a resin portion covering the circuit board and the connector. The connector includes a connector housing having a partition wall separating an internal space from an external space, and a terminal fitting extending through the partition wall, and the connector housing includes a surrounding wall portion disposed on a lateral surface of the partition wall and surrounding the terminal fitting, with a potting material being disposed inside the surrounding wall portion.

According to the above configuration, the portion of the partition wall through which the terminal fitting extends is separated from the resin portion with a potting material. This makes it possible to prevent the melted resin from entering the hood portion through the penetration portion of the terminal fitting on the partition wall when a resin portion is formed by mold forming.

In the above configuration, the resin portion may be formed from a hotmelt adhesive.

Using a hotmelt adhesive as a material for the resin portion makes it possible to mold the resin portion at a low pressure. Combining with sealing with a potting material can reliably prevent the melted resin from entering the hood portion through the penetration portion of the terminal fitting on the partition wall at the time of molding.

A circuit device disclosed in this specification can prevent a melted resin from entering a hood portion through the penetration portion of a terminal fitting on a partition wall when a resin portion is formed by mold forming.

DETAILED DESCRIPTION

An embodiment will be described with reference to FIGS. 1 to 9. A circuit device according to this embodiment is an electronic control unit (ECU) 1 disposed in a wheel house of a vehicle in an electric brake system and configured to control braking. As shown in FIG. 2, the ECU 1 includes a circuit board 10, a connector 20 fixed to one surface of the circuit board 10, and a resin portion 50 made of a synthetic resin and covering the circuit board 10 and the connector 20.

The circuit board 10 is a member having a known configuration, which has electrically conducting paths (not shown) formed by a printed wiring technique on one or both surfaces of an insulating plate made of an insulating material and on which electronic components (not shown) are mounted.

Figure 3:
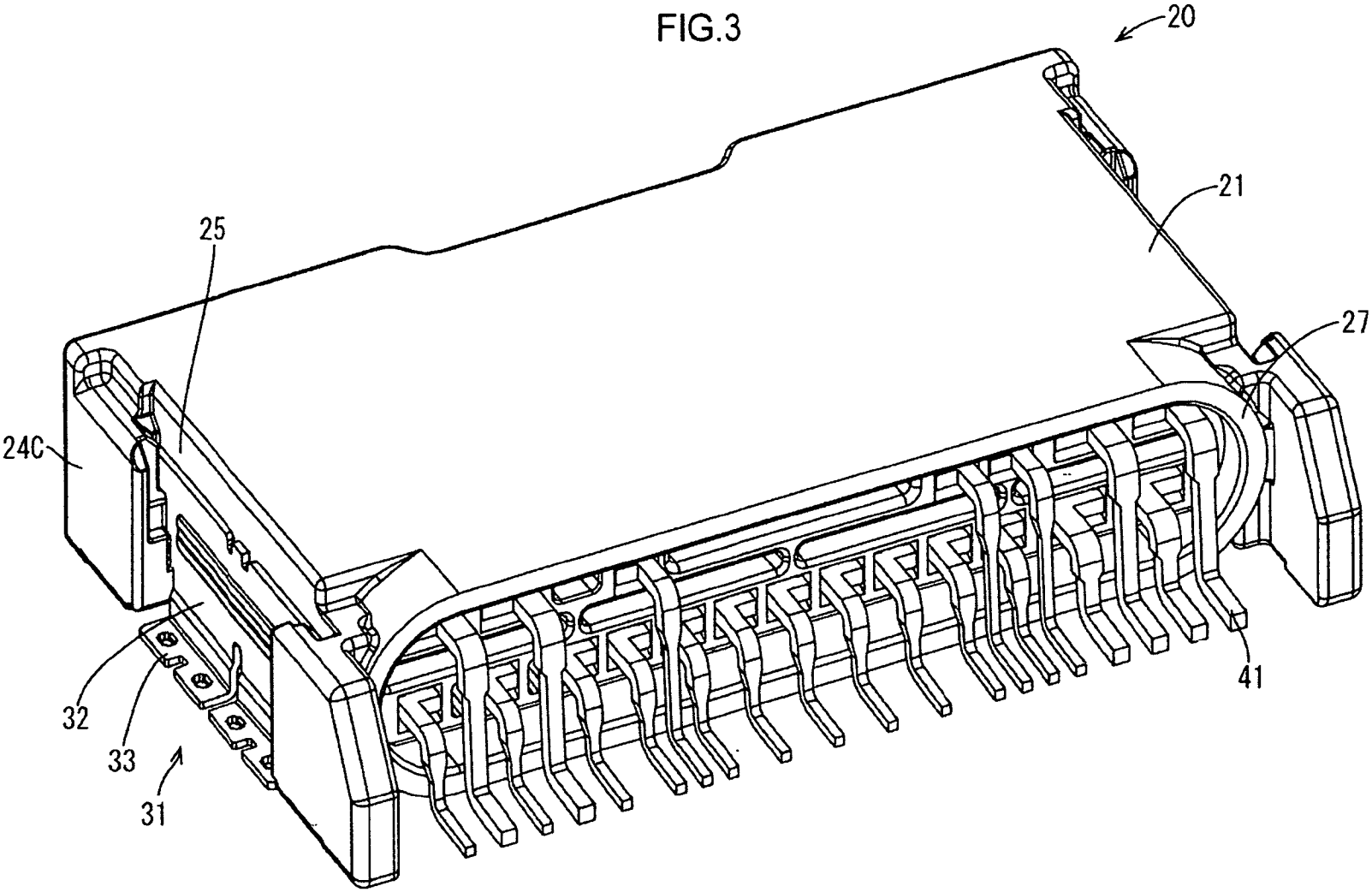
FIG. 3 is a perspective view of a connector before filling with a potting material according to the embodiment.
Figure 4:
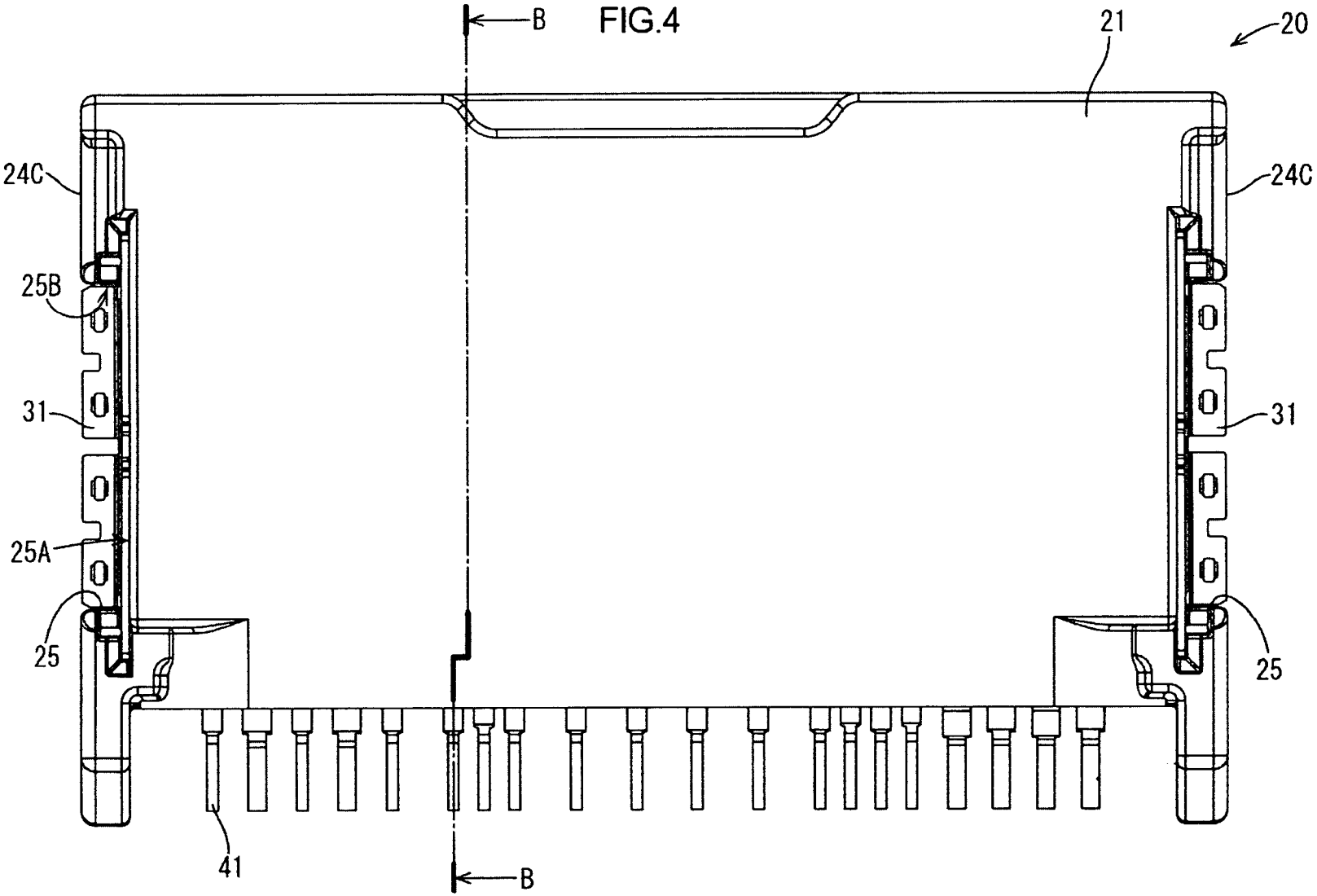
FIG. 4 is a plan view of the connector before filling with a potting material according to the embodiment.

As shown in FIGS. 3 and 4, the connector 20 includes a connector housing 21, two fixing fittings 31 for fixing the connector housing 21 to the circuit board 10, and a plurality of terminal fittings 41 fixed to the connector housing 21 and connected to the electrically conducting paths on the circuit board 10.

Figure 5:
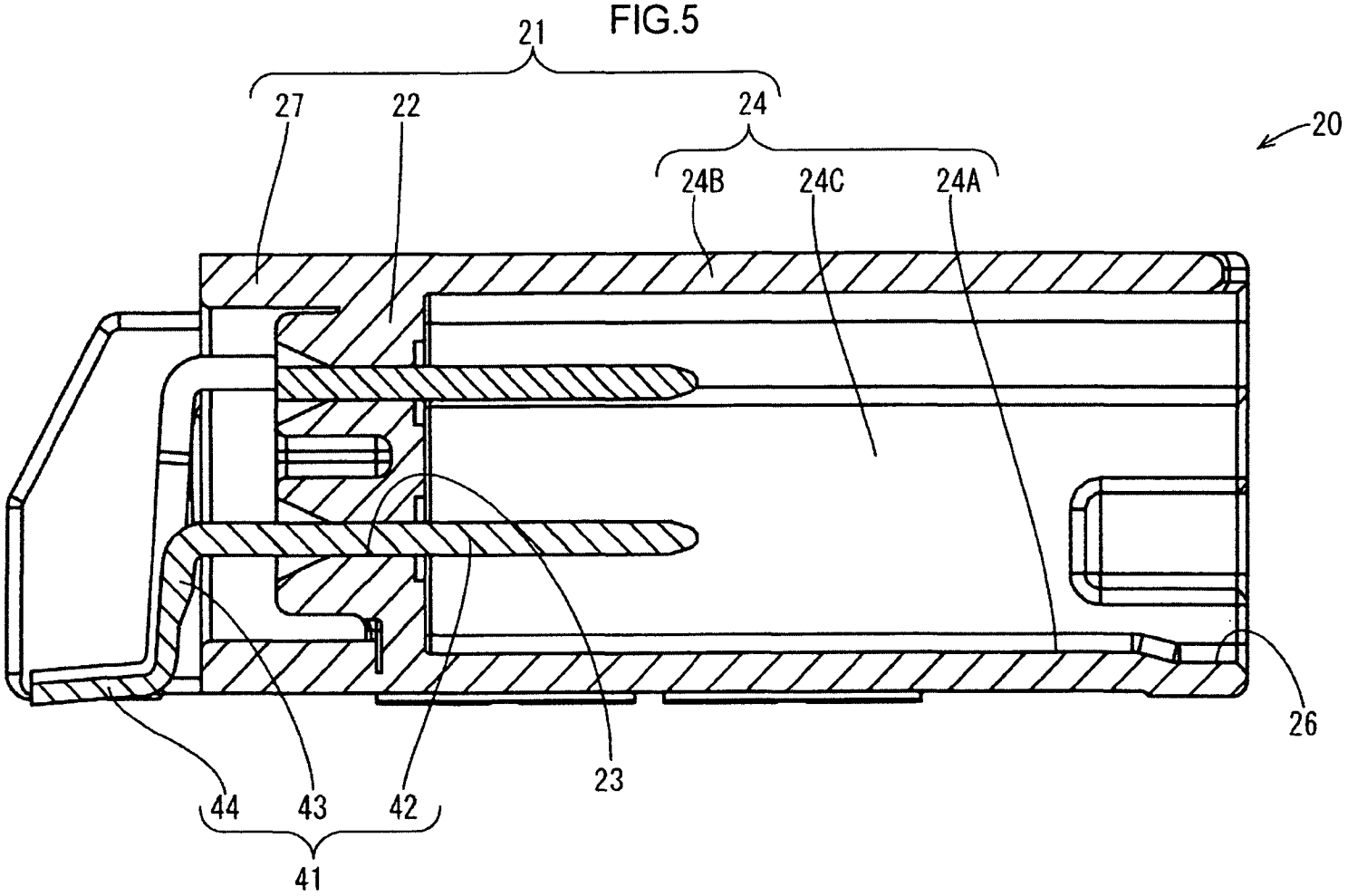
FIG. 5 is a sectional view taken along line B-B in FIG. 4.

As shown in FIG. 5, the connector housing 21 is made of a synthetic resin and includes a terminal holding wall 22 (corresponding to the partition wall), a hood portion 24 continuous from the terminal holding wall 22, and a surrounding wall portion 27 continuous from the terminal holding wall 22 like the hood portion 24.

As shown in FIG. 5, the terminal holding wall 22 is a plate-like portion having a thickness enough to hold the terminal fittings 41 and includes a plurality of press fitting holes 23 into which the terminal fittings 41 can be press-fit. The hood portion 24 is a rectangular cylindrical portion extending from one surface of the terminal holding wall 22, and includes a bottom wall 24A disposed along the circuit board 10, a top wall 24B parallel to the bottom wall 24A, and two side walls 24C joining the bottom wall 24A to the top wall 24B, and has an opening portion 26 on the opposite side to the terminal holding wall 22. The internal space of the connector housing 21 surrounded by the terminal holding wall 22 and the hood portion 24 can accommodate a mating connector.

Figure 6:
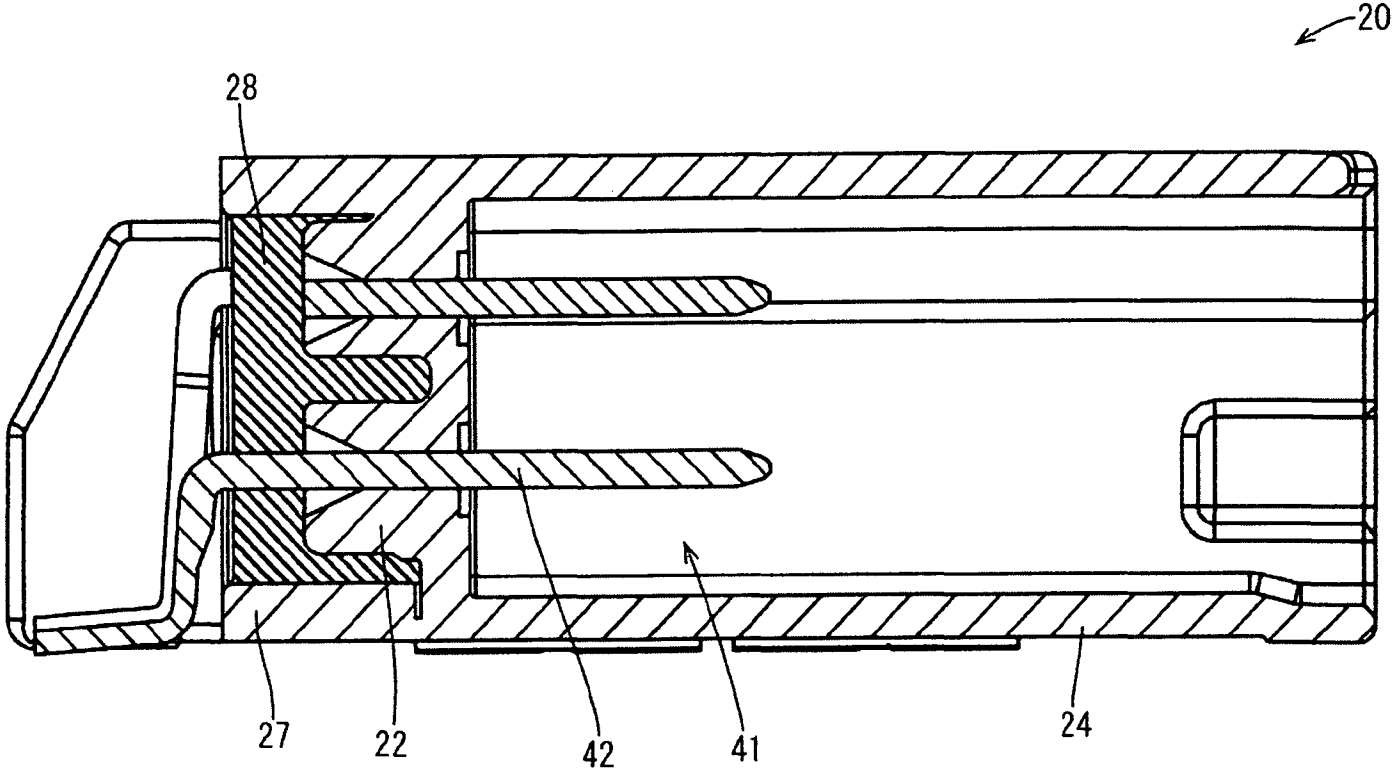
FIG. 6 is a sectional view of the connector filled with the potting material taken at the same position as line B-B in FIG. 4 according to the embodiment.
Figure 7:
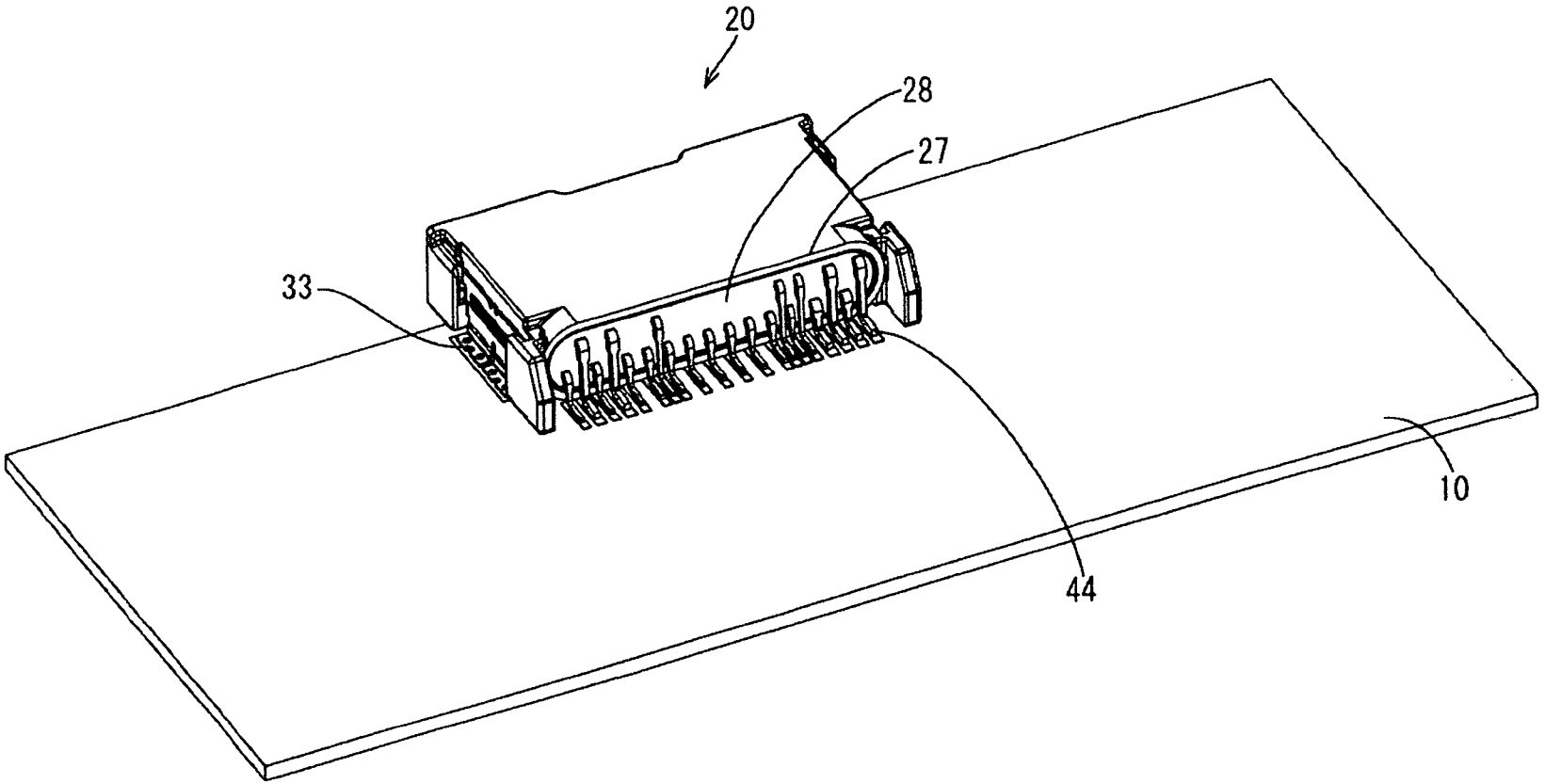
FIG. 7 is a perspective view of a circuit board to which the connector is fixed according to the embodiment.

As shown in FIGS. 3 and 5, the surrounding wall portion 27 is a substantially elliptic cylindrical portion erected from a lateral surface of the terminal holding wall 22 (a surface on the opposite side to the hood portion 24). As shown in FIG. 6, the space surrounded by the surrounding wall portion 27 and the terminal holding wall 22 is filled with a potting material 28. As the potting material 28, for example, a thermoset resin such as epoxy resin can be used.

As shown in FIGS. 3 and 4, each of the two side walls 24C has a mounting groove 25. Each mounting groove 25 is a wide groove defined by a groove bottom surface 25A parallel to a lateral surface of the side wall 24C and a pair of groove side surfaces 25B continuous from the groove bottom surface 25A and parallel to the terminal holding wall 22, and extends from top wall 24B to the bottom wall 24A.

Each of the two fixing fittings 31 is a member formed by pressing a metal plate and has an L shape as a whole, including a substantially rectangular main body portion 32 and a mounting portion 33 in the form of a plate piece extending vertically from one side of the main body portion 32, as shown in FIG. 3. Although not shown in detail, a plurality of locking pieces are arranged on each of two side edges (two sides perpendicular to one side to which the mounting portion 33 is connected) of the main body portion 32, and engagement receiving portions with which the plurality of locking pieces engage are arranged on each of the pair of groove side surfaces 25B.

As shown in FIG. 4, one fixing fitting 31 is accommodated in the mounting groove 25 disposed in one side wall 24C, and the other fixing fitting 31 is accommodated in the mounting groove 25 disposed in the other side wall 24C. Each fixing fitting 31 is disposed, with the main body portion 32 extending along the groove bottom surface 25A, and is held while being positioned, with the mounting portion 33 being disposed along the circuit board 10, by engaging the locking piece with the engagement receiving portion (see also FIG. 7). The mounting portion 33 is fixed to the circuit board 10 by reflow soldering.

As shown in FIG. 5, each of the plurality of terminal fittings 41 is a member formed by bending an elongated metal plate material, and is constituted by a tab portion 42 press-fitted into the press fitting hole 23 and extending through terminal holding wall 22, an intermediate portion 43 extending substantially vertically from one end of the tab portion 42, and a board connecting portion 44 extending from an extending end of the intermediate portion 43 in a direction opposite to the tab portion 42. The distal end portion of the tab portion 42 is disposed inside the hood portion 24. In addition, a proximal end portion near an intermediate portion 43 is surrounded by the surrounding wall portion 27 and embedded in the potting material 28. The board connecting portions 44 are arranged along the circuit board 10 and electrically connected to the electrically conducting paths by reflow soldering.

Figure 8:
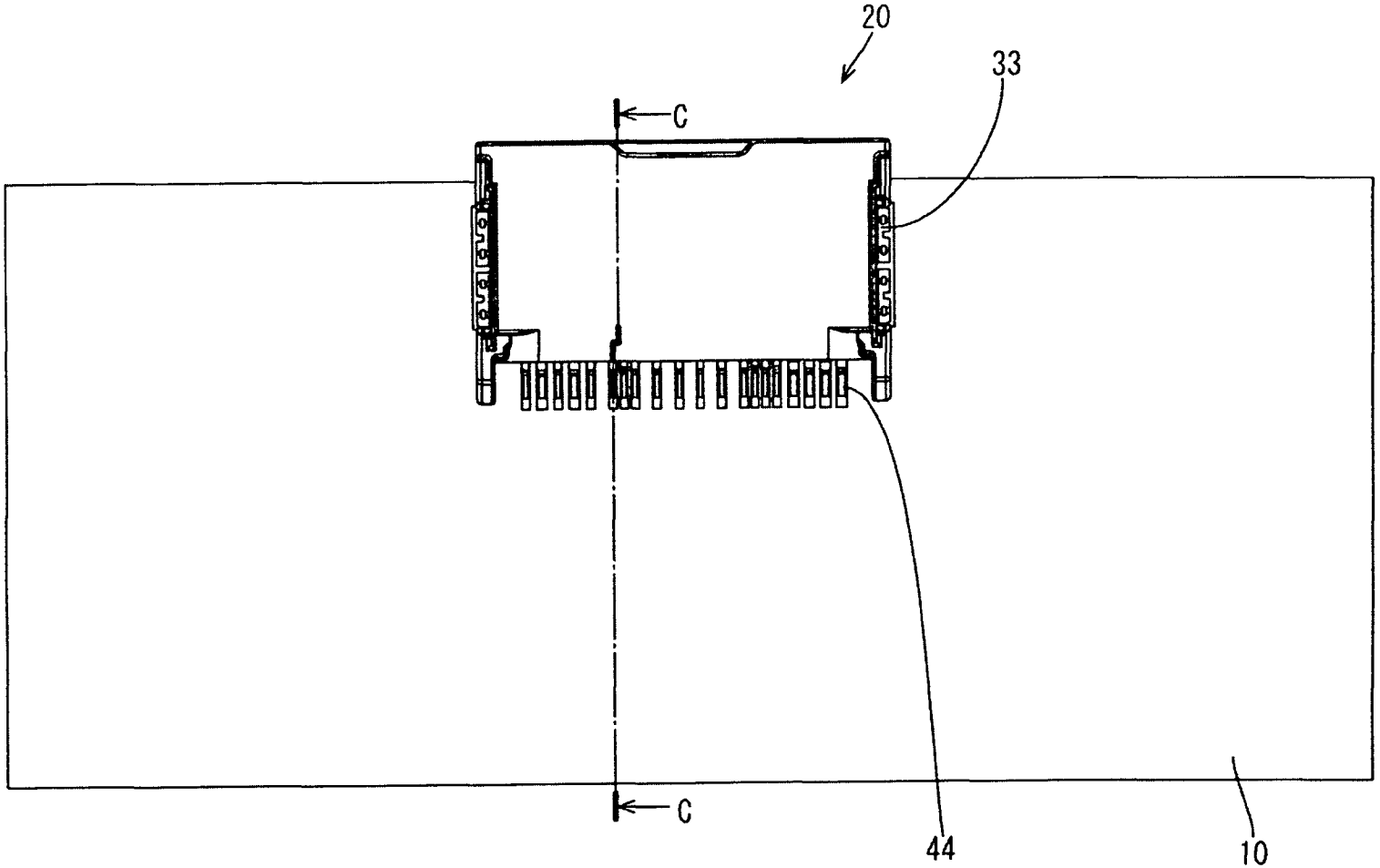
FIG. 8 is a plan view of the circuit board to which the connector is fixed according to the embodiment.
Figure 9:
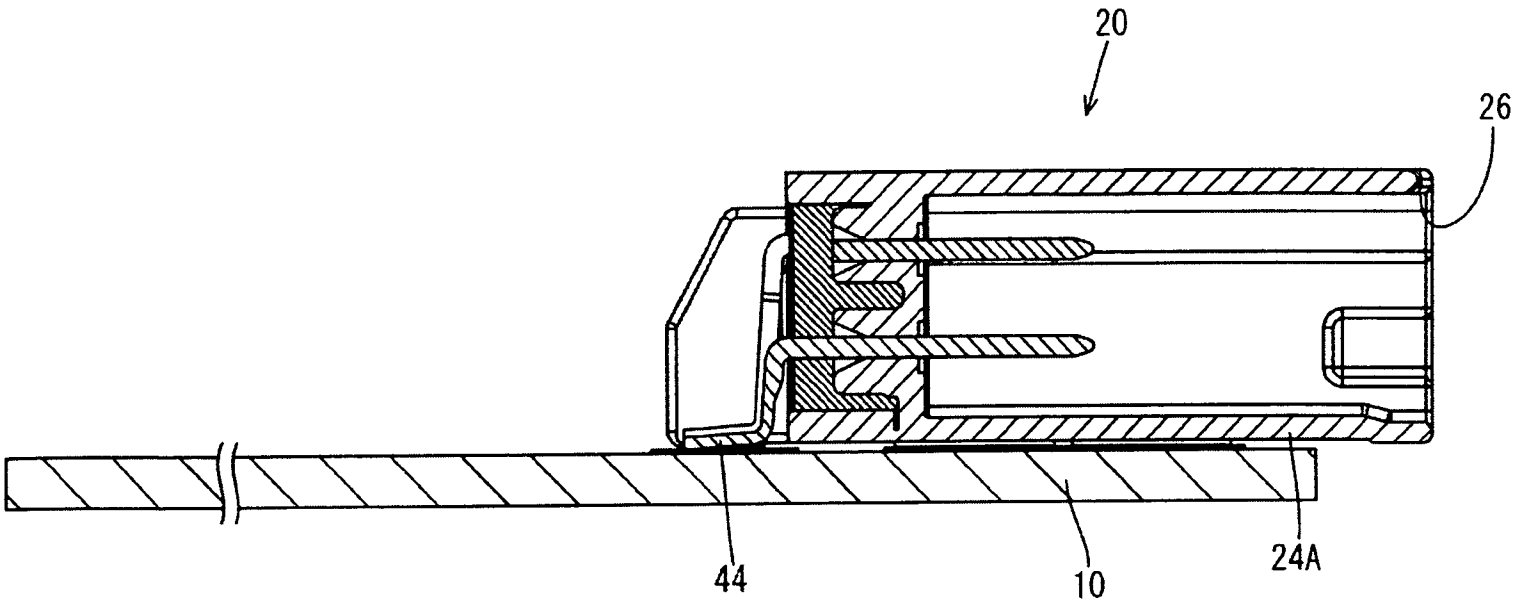
FIG. 9 is a sectional view taken along line C-C in FIG. 8.

As shown in FIGS. 8 and 9, the connector 20 is fixed to the circuit board 10 such that the bottom wall 24A is directed to face the circuit board 10, and a portion of the hood portion 24 which is adjacent to an opening portion 26 protrudes from an end edge of the circuit board 10 by a predetermined dimension.

Figure 1:
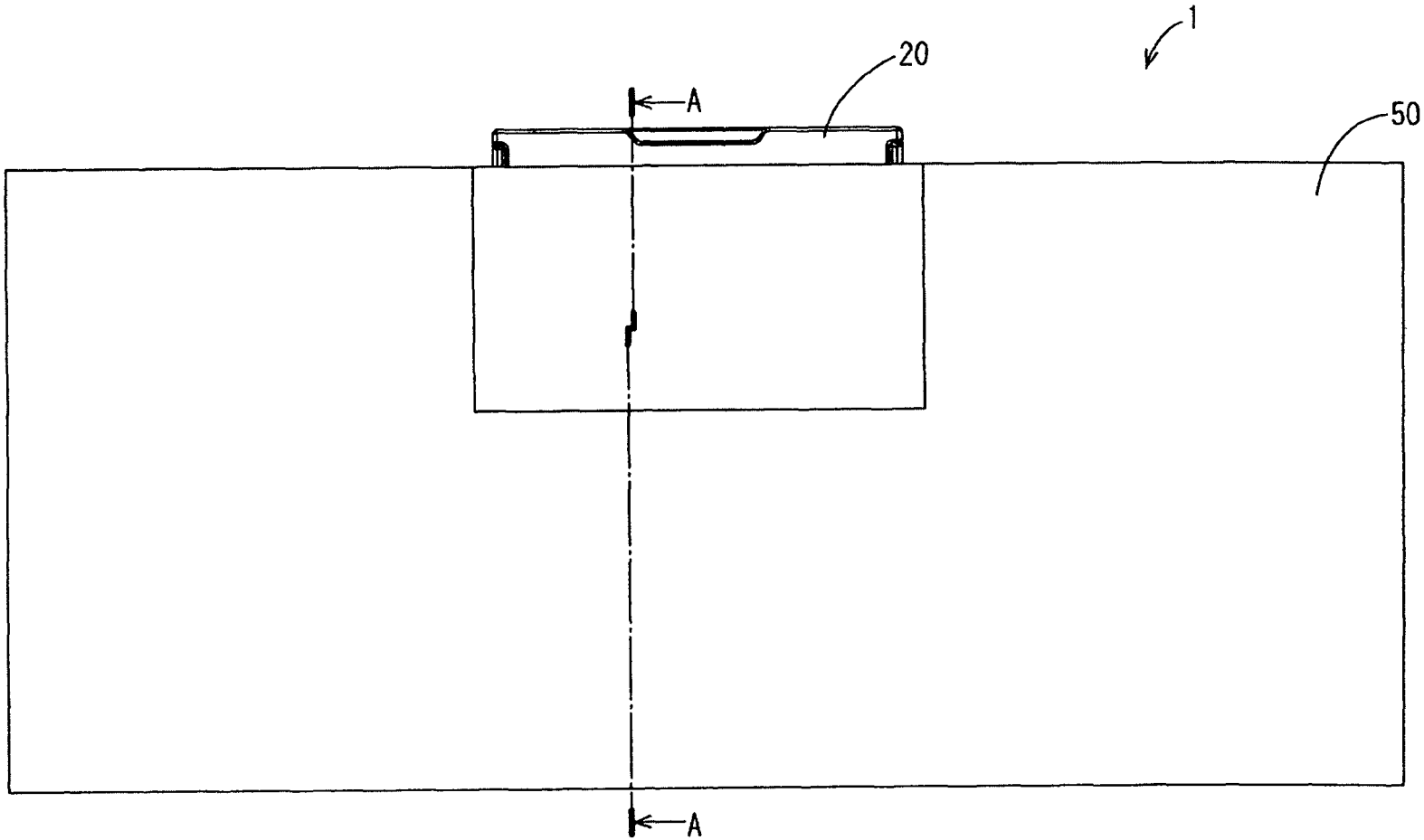
FIG. 1 is a plan view of an ECU according to an embodiment.
Figure 2:
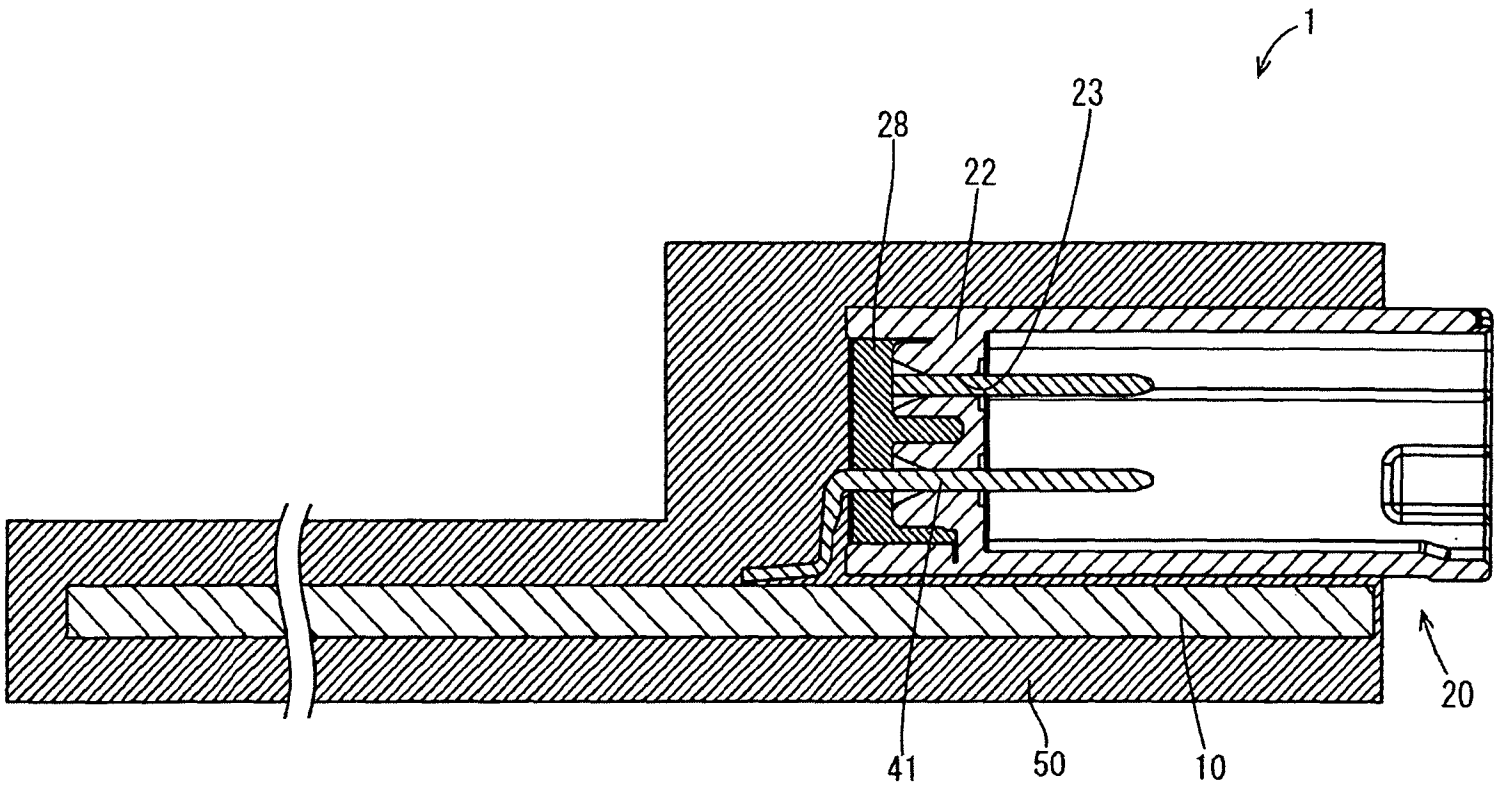
FIG. 2 is a sectional view taken along line A-A in FIG. 1.

As shown in FIGS. 1 and 2, the resin portion 50 covers the entire circuit board 10 and a portion of the connector 20 other than a portion protruding from the end edge of the circuit board 10 in a tight contact state. The resin portion 50 can be formed by mold forming using a hotmelt adhesive.

For example, the following is a procedure for manufacturing the ECU 1 having the above configuration.

First of all, the terminal fittings 41 and the fixing fittings 31 are fixed to the connector housing 21. The inside of the surrounding wall portion 27 is then filled with the liquid potting material 28. The potting material 28 is cured.

The connector 20 is then fixed to the circuit board 10 by reflow soldering. First of all, solder is applied to each soldering target region on one surface of the circuit board 10. Subsequently, the connector 20 is mounted on one surface of the circuit board 10 such that a portion of the hood portion 24 which is adjacent to the opening portion 26 protrudes from an end edge of the circuit board 10 by a predetermined dimension (see FIGS. 8 and 9). At this time, the board connecting portion 44 of each terminal fitting 41 is mounted on the solder, and the mounting portion 33 of each fixing fitting 31 is also mounted on the solder. The circuit board 10 on which the connector 20 is mounted is transported in a reflow furnace (not shown) to melt the solder. When the solder is cooled and solidified, the board connecting portion 44 of each terminal fitting 41 is fixed and rendered conductive to the corresponding electrically conducting path, and the mounting portion 33 of each fixing fitting 31 is fixed to the circuit board 10. This fixes the connector housing 21 to the circuit board 10.

The resin portion 50 is then formed by mold forming. The circuit board 10 to which the connector 20 is fixed is set in a mold (not shown), and the mold is filled with a melted resin. In this case, the potting material 28 disposed inside the surrounding wall portion 27 separates a portion around the portion of the terminal holding wall 22 through which each terminal fitting 41 extends from the melted resin injected in the hold. This prevents the melted resin from flowing into the hood portion 24 through the press fitting holes 23.

Subsequently, the filled resin is cooled and solidified. The ECU 1 is completed in this manner.

As described above, according to this embodiment, the ECU 1 includes the circuit board 10, the connector 20 fixed to the circuit board 10, and the resin portion 50 covering the circuit board 10 and the connector 20. The connector 20 includes the connector housing 21 having the terminal holding wall 22 that separates the internal space from the external space, and the terminal fittings 41 extending through the terminal holding wall 22. The connector housing 21 includes the surrounding wall portion 27 that is disposed on the lateral surface of the terminal holding wall 22 and surrounds the terminal fittings 41. The potting material 28 is disposed inside the surrounding wall portion 27.

According to the above configuration, a portion around the portion of the terminal holding wall 22 through which each terminal fitting 41 extends is separated from the resin portion 50 by the potting material 28. This can prevent the melted resin from entering the hood portion 24 through the press fitting holes 23 at the time of formation of the resin portion 50 by mold forming.

The resin portion 50 is formed from a hotmelt adhesive. Using a hotmelt adhesive as a material for the resin portion 50 makes it possible to mold the resin portion 50 at a low pressure. Combining with sealing with the potting material 28 can reliably prevent the melted resin from entering the hood portion 24 through the press fitting holes 23 at the time of molding.

OTHER EMBODIMENTS

The technology disclosed in this specification is not limited to the embodiment described with reference to the above description and drawings, and includes, for example, the following aspects.

(1) Although the surrounding wall portion 27 is a cylindrical wall portion erected on the lateral surface of the terminal holding wall 22 in the above embodiment, the terminal holding wall may have a concave portion concaved from the lateral surface and the inner wall of the concave portion may be used as a surrounding wall portion.

(2) Although the terminal holding wall 22 has the press fitting holes 23 and the tab portions 42 of the terminal fittings 41 are press-fitted into the press fitting holes 23 in the above embodiment, the terminal fittings and the connector housing may be integrally formed by insert molding.

EXPLANATION OF SYMBOLS

1: ECU (circuit device)
10: circuit board
20: connector
21: connector housing
22: terminal holding wall (partition wall)
27: surrounding wall portion
28: potting material
41: terminal fitting
50: resin portion

The invention claimed is:

1. A circuit device comprising:
a circuit board;
a connector fixed to the circuit board, the connector including a connector housing that comprises:
a partition wall projecting away from the circuit board and having opposite inner and outer surfaces;
an internal space defined forward of the partition wall;
a surrounding wall projecting rearward from the partition wall and defining an external space rearward of the partition wall; and
at least one terminal fitting penetrating through the partition wall, a part of the at least one terminal fitting rearward of the partition wall being within the external space and surrounded by the surrounding wall; and
a potting material being disposed inside the surrounding wall and on the outer surface of the partition wall; and
a resin portion formed from a hotmelt adhesive and covering the circuit board and outer surfaces of both the connector housing and the potting material.

2. The circuit device of claim 1, wherein:
the partition wall includes at least one protrusion protruding from the outer surface and a recess recessed in the outer surface; and
the at least one terminal fitting penetrates the protrusion.

3. The circuit device of claim 2, wherein:
a rearward projecting distance of the at least one protrusion from the outer surface of the partition wall is less than a rearward projecting distance of the surrounding wall from the outer surface of the partition wall.

4. The circuit device of claim 2, wherein
the at least one protrusion comprises plural protrusions,
the at least one terminal fitting comprises plural terminal fittings, and
the plural terminal fittings penetrate respectively through the plural protrusions.

5. The circuit device of claim 2, wherein:
the at least one protrusion comprises plural protrusions so that each of the plural protrusions is adjacent to another one of the plural protrusions,
a part of the recess is between the protrusions that are adjacent to one another, and
the potting material includes a portion filled in the recess.

6. The circuit device of claim 2, wherein:
a part of the recess is between the surrounding wall and the at least one protrusion, and
the potting material includes a portion filled in the recess.

7. The circuit device of claim 1, wherein:
the at least one terminal fitting includes:
a tab penetrating the partition wall;
a board connecting portion connected to a surface of the circuit board; and
an intermediate portion extending between the tab and the board connecting portion, the intermediate portion extending along a surface of the potting material opposed to the resin portion.

8. The circuit device of claim 1, wherein:
the at least one terminal fitting includes plural terminal fittings, each of the terminal fittings includes a tab, a board connecting portion and an intermediate portion,
the tabs of the plural terminal fittings penetrate the partition wall,
the board connecting portions of the plural terminal fittings are connected to a surface of the circuit board,
the intermediate portions of the plural terminal fittings extend between the tabs and the respective board connecting portions,
the intermediate portions of the plural terminal fittings extend along a surface of the potting material opposed to the resin portion, and
the board connecting portions are arranged in line along the connector housing.

9. The circuit device of claim 1, wherein:
the connector housing further includes a hood projecting forward from the partition wall and surrounding the internal space.

* * * * *